US009790740B2

(12) United States Patent
Bardill et al.

(10) Patent No.: US 9,790,740 B2
(45) Date of Patent: Oct. 17, 2017

(54) PAINT BUCKET STEP LADDER HOOK WITH DESIGN HANDLE

(71) Applicants: Stephen Albert Bardill, Sterling Heights, MI (US); Vito Monteleone, Sterling Heights, MI (US)

(72) Inventors: Stephen Albert Bardill, Sterling Heights, MI (US); Vito Monteleone, Sterling Heights, MI (US)

( * ) Notice: Subject to any disclaimer, the term of this patent is extended or adjusted under 35 U.S.C. 154(b) by 0 days.

(21) Appl. No.: 13/999,892

(22) Filed: Apr. 2, 2014

(65) Prior Publication Data

US 2015/0285001 A1 Oct. 8, 2015

(51) Int. Cl.
*E06C 7/14* (2006.01)

(52) U.S. Cl.
CPC ..... *E06C 7/14* (2013.01); *E06C 7/146* (2013.01)

(58) Field of Classification Search
USPC ... 248/210, 211, 238, 95, 99, 100, 303, 339; 182/129
See application file for complete search history.

(56) References Cited

U.S. PATENT DOCUMENTS

| | | | | |
|---|---|---|---|---|
| 2,991,037 | A * | 7/1961 | Becher, Jr. | E06C 7/146 248/211 |
| 6,474,607 | B1 * | 11/2002 | Wilson | E06C 7/143 182/129 |
| 6,585,204 | B1 * | 7/2003 | Haertzen | E06C 7/14 182/129 |
| 7,387,323 | B1 * | 6/2008 | Minnette | B44D 3/14 220/756 |
| 7,789,358 | B1 * | 9/2010 | Adams | E06C 7/146 248/211 |
| 8,863,981 | B1 * | 10/2014 | Fontaine | B65D 25/28 220/755 |
| 2014/0265382 | A1 * | 9/2014 | Bajuyo | A45F 5/021 294/15 |

* cited by examiner

*Primary Examiner* — Steven Marsh

(57) ABSTRACT

A step ladder step hook (110) and 45 degree offset horizontal frame (112) intersect to create an embodiment for a vertical thumb rest (114) and vertical handle (116). This handle makes it faster, safer, and easy for a user to move a can of paint or utility bucket from step to step on a step ladder. Left- or right-handed painters can maneuver their can of paint or utility bucket with our unique easy to grip handle. A lower vertical hook (118) will easily hook to a can of paint or utility bucket. The step ladder hook (110) will simply be hung to the step ladder step through the easy to grip handle.

1 Claim, 15 Drawing Sheets

114
112
116
110
118

Fig.4G
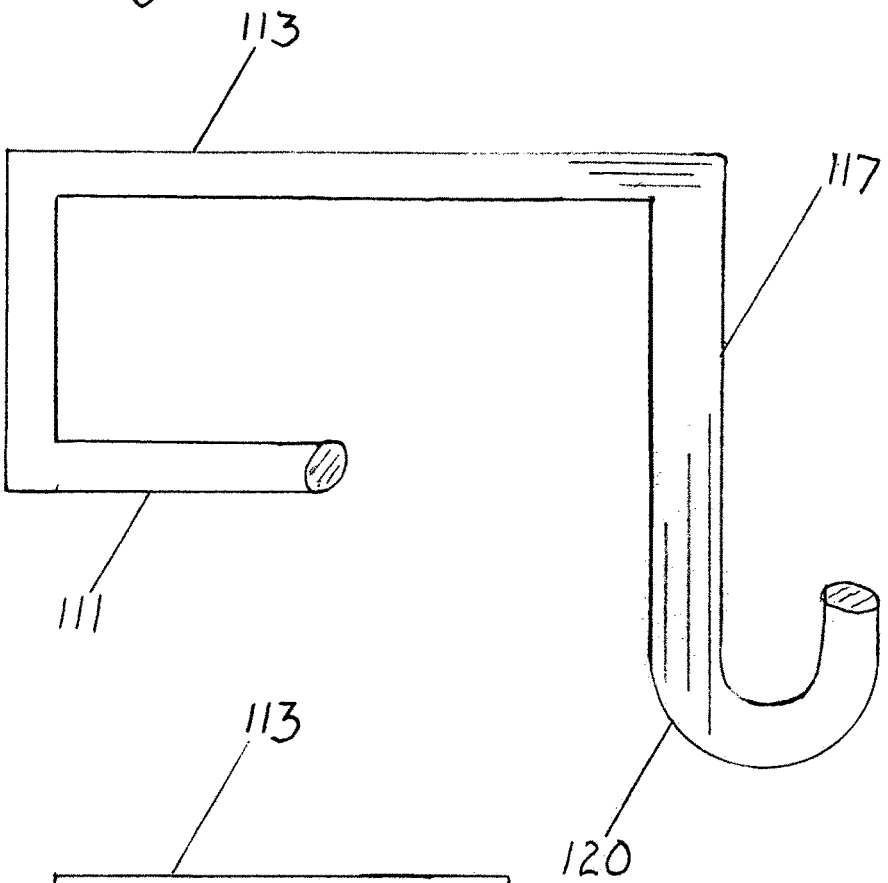
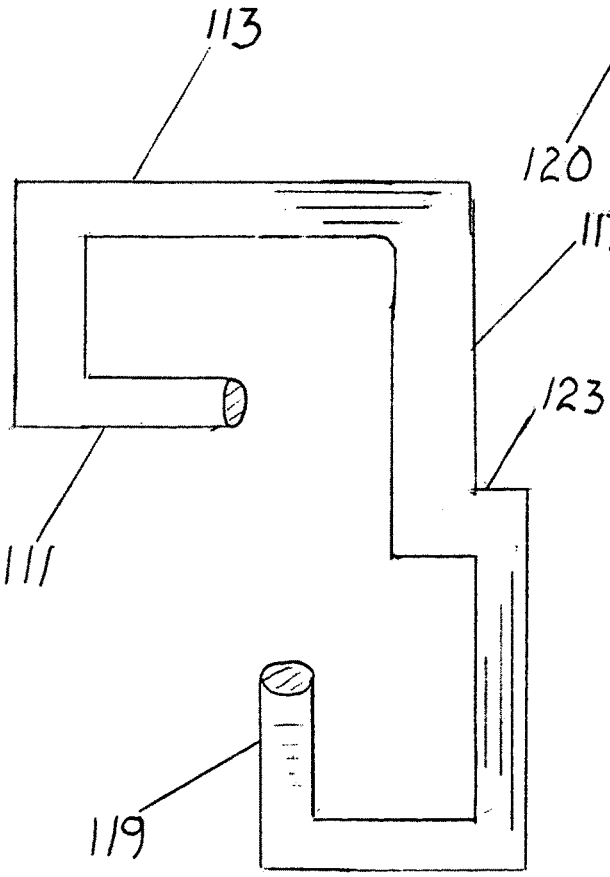
Fig.4H

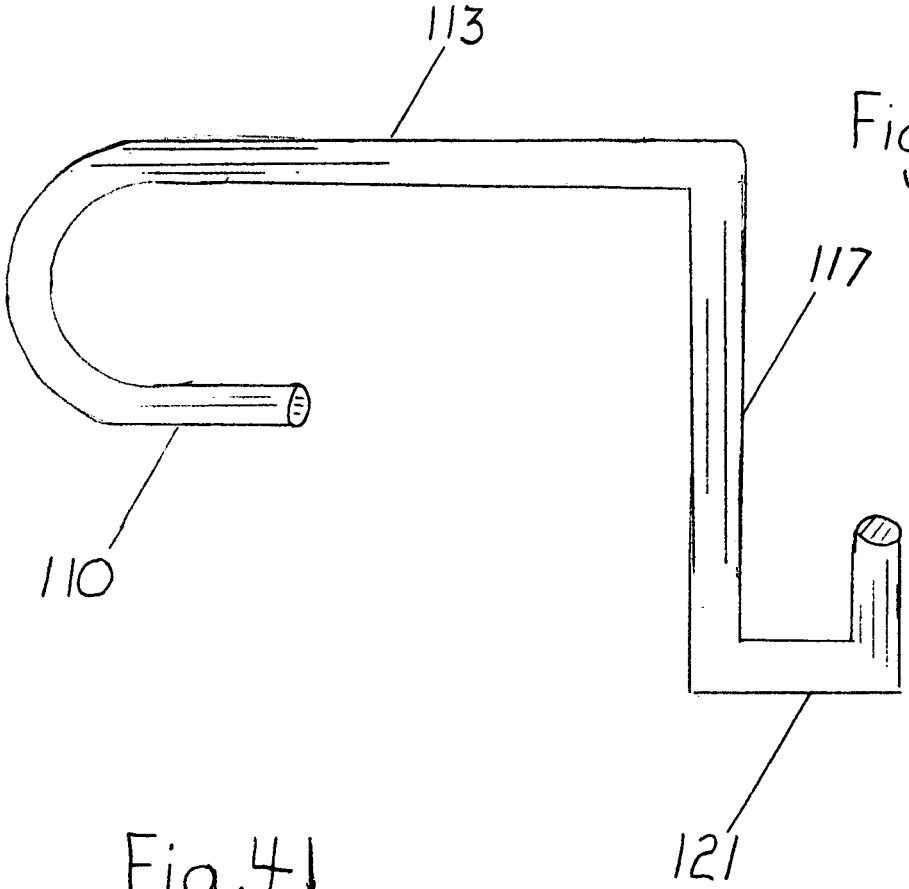
Fig.4K
Fig.4L
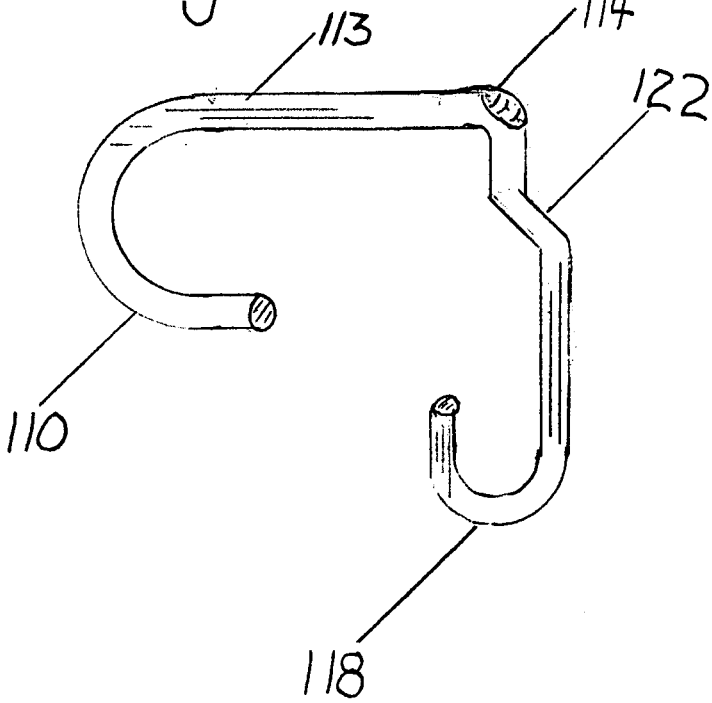

Fig. 4M
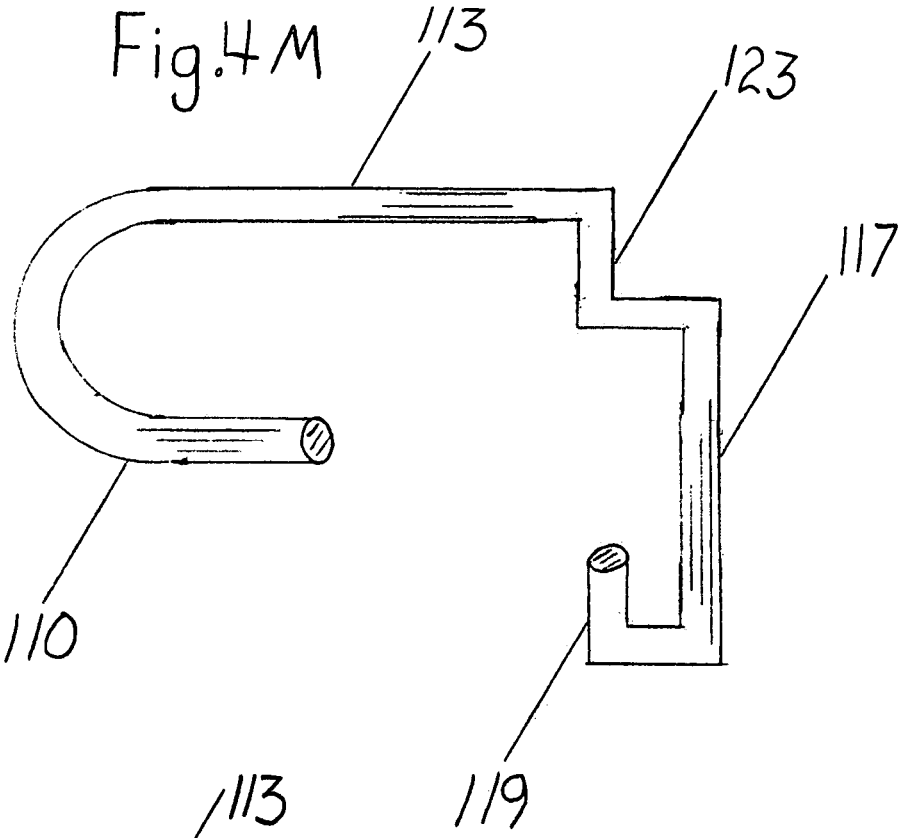
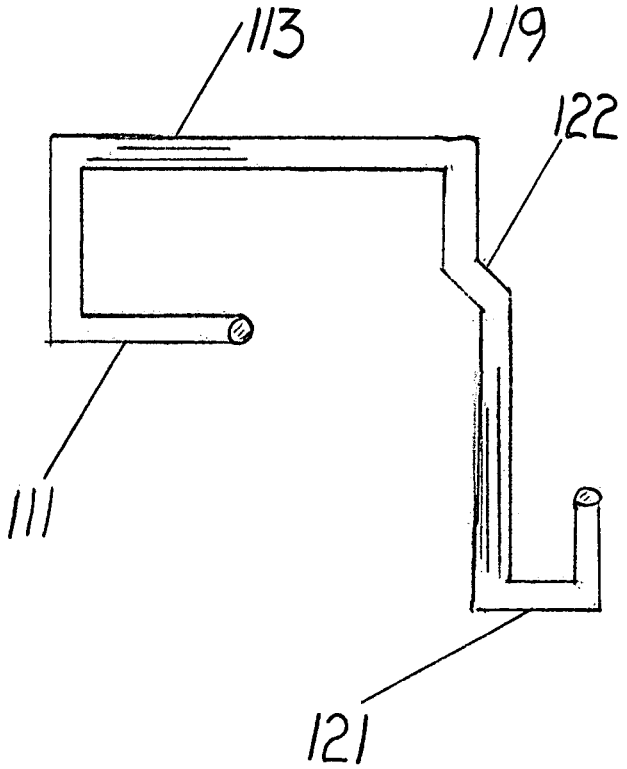
Fig. 4N

Fig.4 O
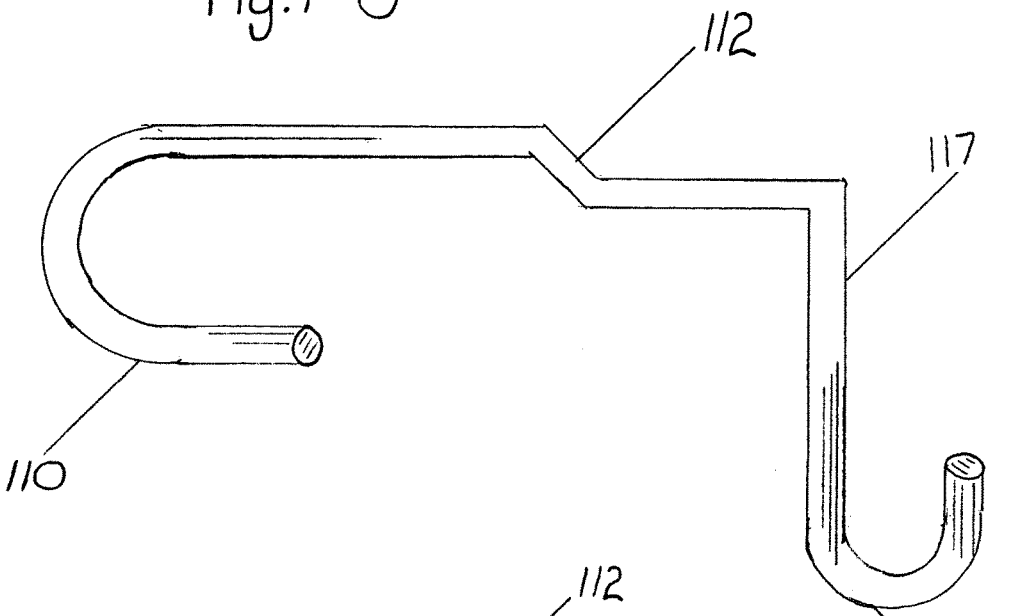
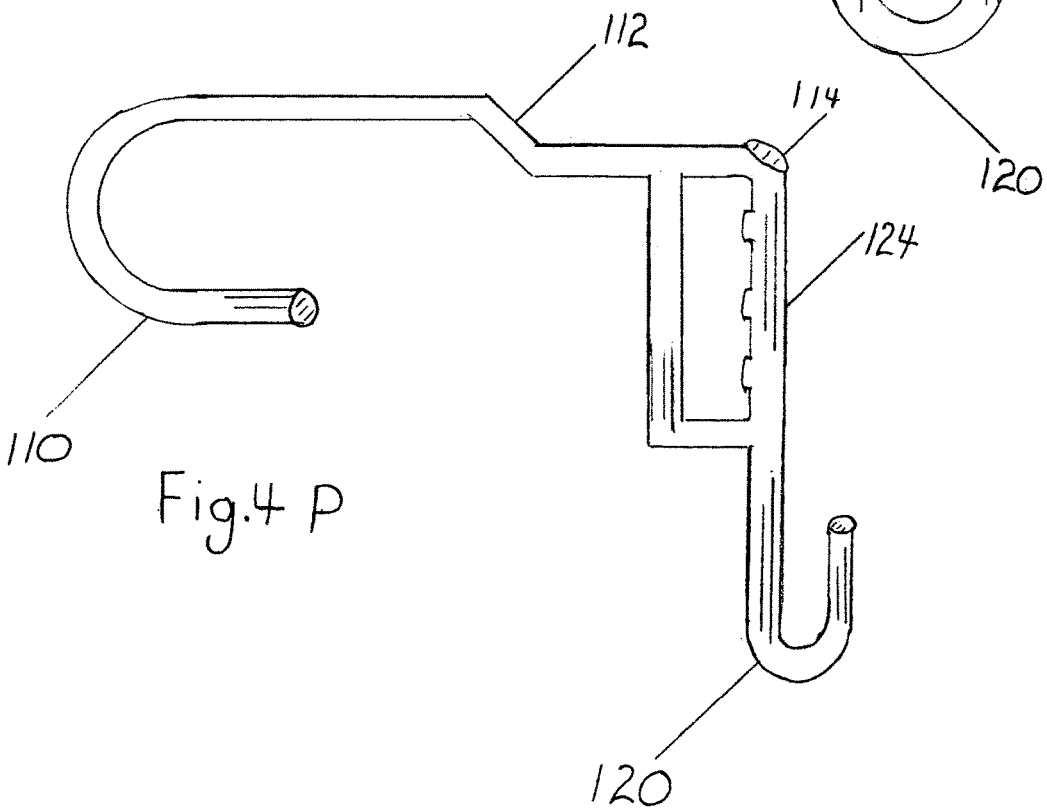
Fig.4 P

PAINT BUCKET STEP LADDER HOOK WITH DESIGN HANDLE

CROSS-REFERENCE TO RELATED APPLICATIONS

Not Applicable

FEDERALLY SPONSORED RESEARCH

Not Applicable

SEQUENCE LISTING OR PROGRAM

Not Applicable

BACKGROUND OF THE INVENTION

Field of Invention

This invention relates to a paint bucket hook for attaching a can of paint, or a utility bucket securely to a step ladder.

Prior Art

Not Applicable

Objects and Advantages

Several objects and advantages of the present invention are:

(a) To provide a paint bucket step ladder hook with design handle.

(b) To provide a paint bucket step ladder hook for a step ladder for right- and left-handed painters.

(c) To provide a faster way for the painter or homeowner to move the can of paint, or utility bucket from step to step on a step ladder, as a single unit while the paint can or utility bucket is securely attached to the step ladder hook. This includes moving the can of paint or utility bucket vertical up and vertical down the step of the step ladder.

(d) To provide a safer and easier way for the painter, or homeowner to maneuver the paint can or utility bucket from horizontal left on the step of the step ladder to horizontal right on the step of the step ladder.

(e) To provide an easy-to-grip handle so the painter, or homeowner can move the can of paint or utility bucket from step to step on a step ladder using only one hand.

(f) To provide a strong, secure step ladder hook and handle.

(g) To provide a simple lightweight design for greater maneuverability.

(h) To provide convenient paint can access so the painter or homeowner can improve production.

Further objects and advantages of the invention will become apparent from a consideration of the drawings and ensuing description.

SUMMARY

In accordance with the present invention, the primary object is to provide tradesmen and homeowners a fast and safe way to move the can of paint or utility bucket from step to step on a step ladder. This task can be accomplished by using our step ladder bucket hook. The tradesmen or homeowner simply attaches the utility bucket handle or paint bucket handle to the lower vertical hook, then grips the handle and attaches the can of paint or utility bucket securely to the step of the step ladder through means of the upper horizontal hook.

BRIEF DESCRIPTION OF DRAWINGS

FIG. 2 is for illustrative purposes only and forms no part of the claimed design. Moreover, the broken line in FIG. 2 showing the side of the step ladder rail and step are for illustrative purposes only.

FIG. 4G shows an upper horizontal rectangular hook with a vertical design handle, and a lower reversed design vertical hook.

FIG. 4H displays an upper horizontal rectangular hook with a vertical design handle, and rectangular lower vertical hook.

FIG. 4K shows an upper horizontal hook with a vertical design handle, and a lower reversed rectangular vertical hook.

FIG. 4L displays an upper horizontal hook with a 45 degree offset vertical design handle, and a lower vertical hook.

FIG. 4M shows an upper horizontal hook with a 90 degree horizontal frame, and a rectangular lower vertical hook.

FIG. 4N illustrates an upper horizontal rectangular hook with a 90 degree horizontal frame, and a lower reversed rectangular vertical hook.

FIG. 4O displays an upper horizontal hook with a 45 degree offset horizontal frame, and a lower reversed design vertical hook.

FIG. 4P illustrates an upper horizontal hook with a 45 degree offset horizontal frame, and a vertical closed grip design handle with thumb rest, and a lower reversed design vertical hook.

DRAWINGS

Reference Numerals

Figure 1:
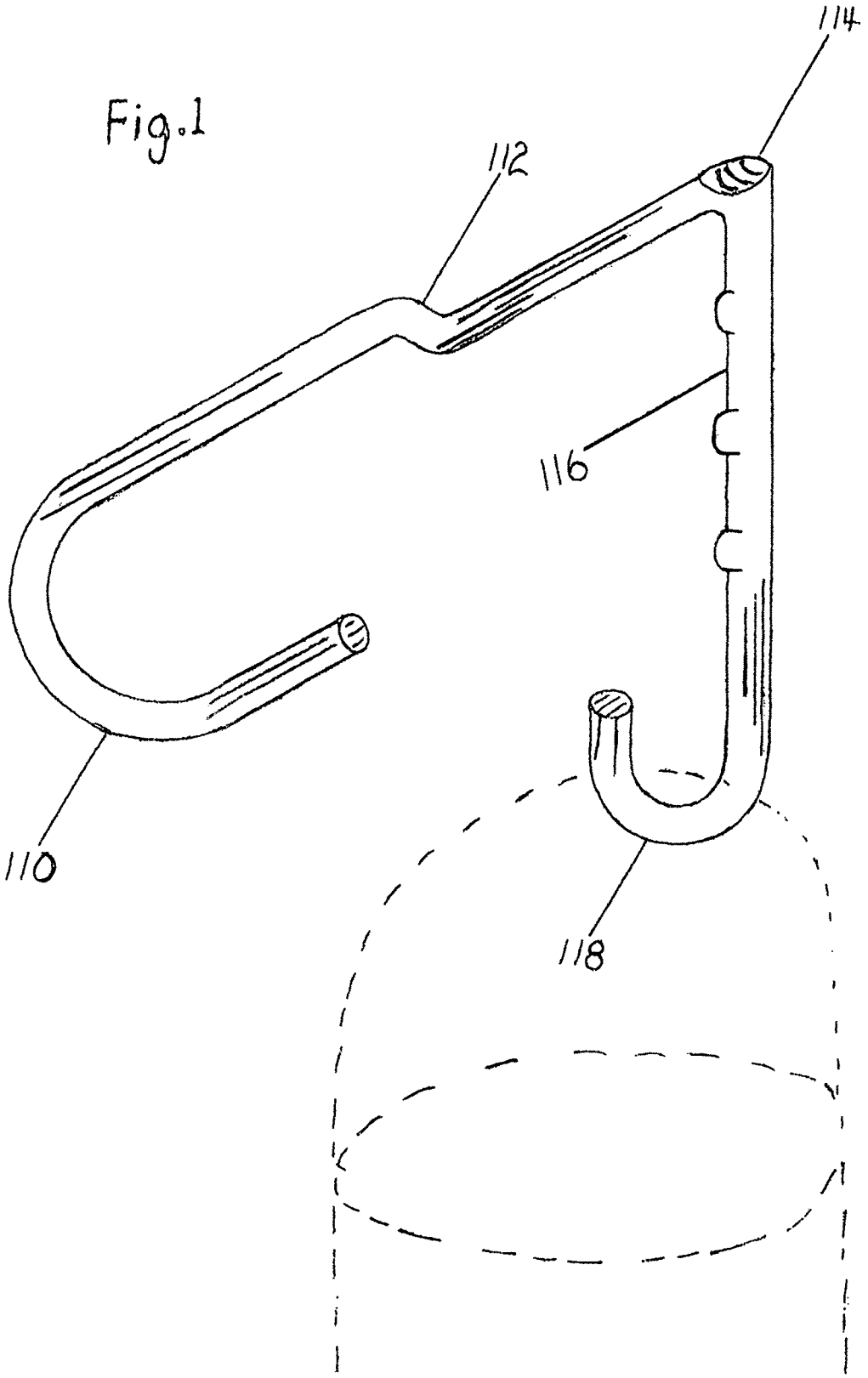
FIG. 1 is an isometric view of the step ladder bucket hook with vertical grip design handle.

110, 210 and 310 upper horizontal hook
111 upper horizontal rectangular hook
112, 212 and 312 45 degree offset horizontal frame
113 horizontal frame
114, 214 and 314 vertical thumb rest
115 45 degree offset upper horizontal frame
116, 216 and 316 vertical design grip handle
117 vertical design handle
118, 218 and 318 lower vertical hook
119 rectangular lower vertical hook
120 lower reversed design vertical hook
121 lower reversed rectangular vertical hook
122 45 degree offset vertical design handle
123 90 degree horizontal frame
124 vertical closed grip design handle
125 left side mount lower vertical hook
126 left side mount lower rectangular vertical hook
127 rectangular cradle

DETAILED DESCRIPTION

Preferred Embodiment

The drawings and especially FIG. 1 show the following: a step ladder bucket hook with vertical design grip handle for moving the paint can or utility bucket quickly from step to step on a step ladder. Constructed in accordance with the invention, a strong plastic is formed in the shape of a hook with a built-in handle. FIG. 1 shown has a rounded step ladder step hook 110 connected to the 45 degree offset horizontal frame 112. 45 degree offset horizontal frame 112 also connects to vertical thumb rest 114. Vertical thumb rest 114 also connects to vertical design grip handle 116. Vertical design grip handle 116 also connects to lower vertical hook 118.

OPERATION

Preferred Embodiment

Figure 2:
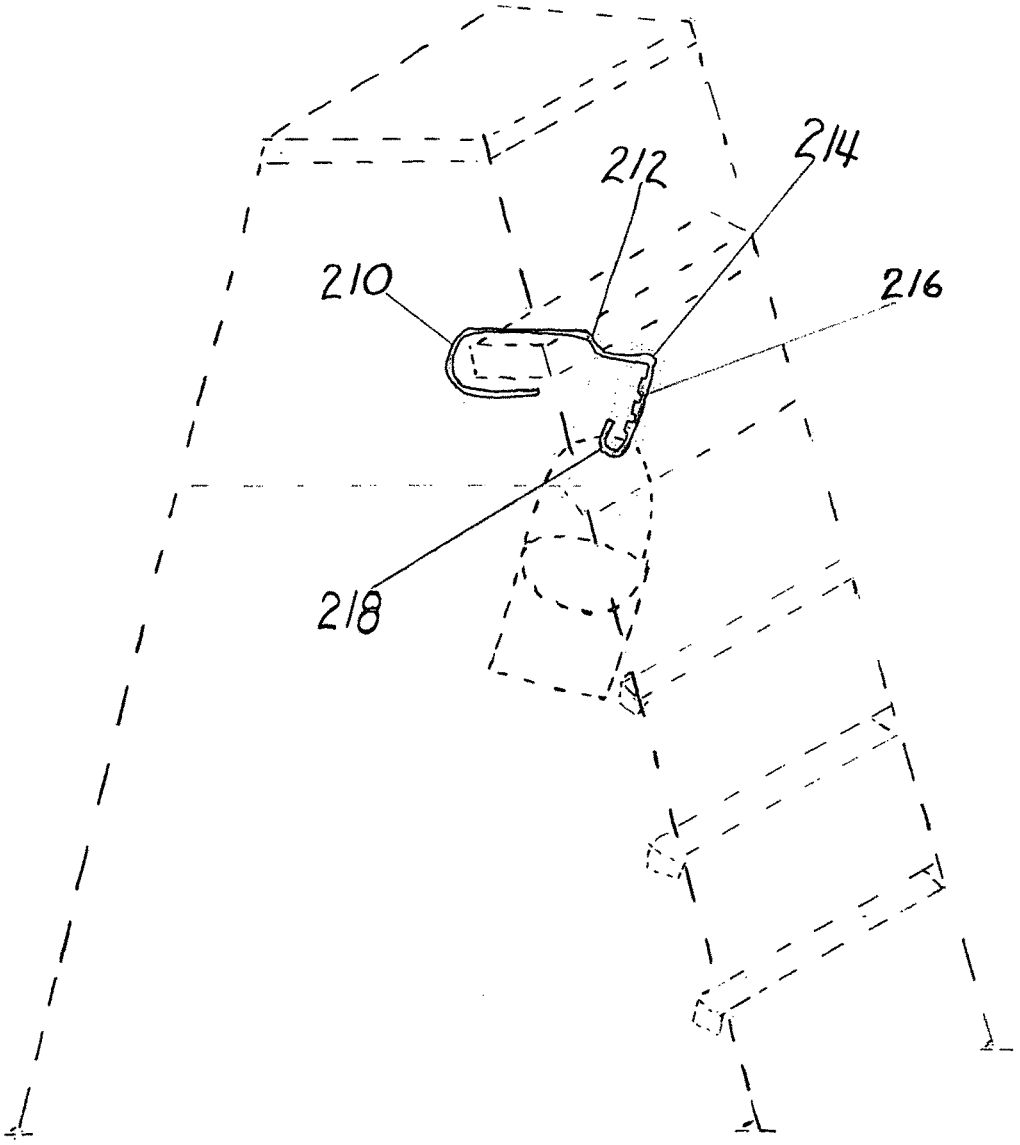
FIG. 2 is a left side view of the step ladder bucket hook securely attached to a step ladder step, with the can of paint or utility bucket securely attached to the lower vertical hook.
Figure 3:
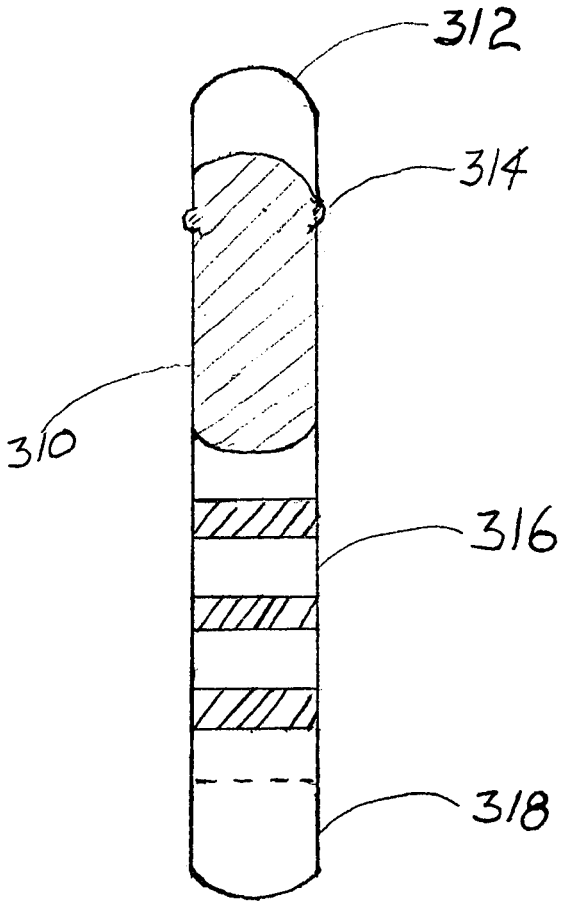
FIG. 3 is a front view of the step ladder bucket hook with vertical grip handle. The broken line showing the paint bucket in FIG. 1
Figure 4A:
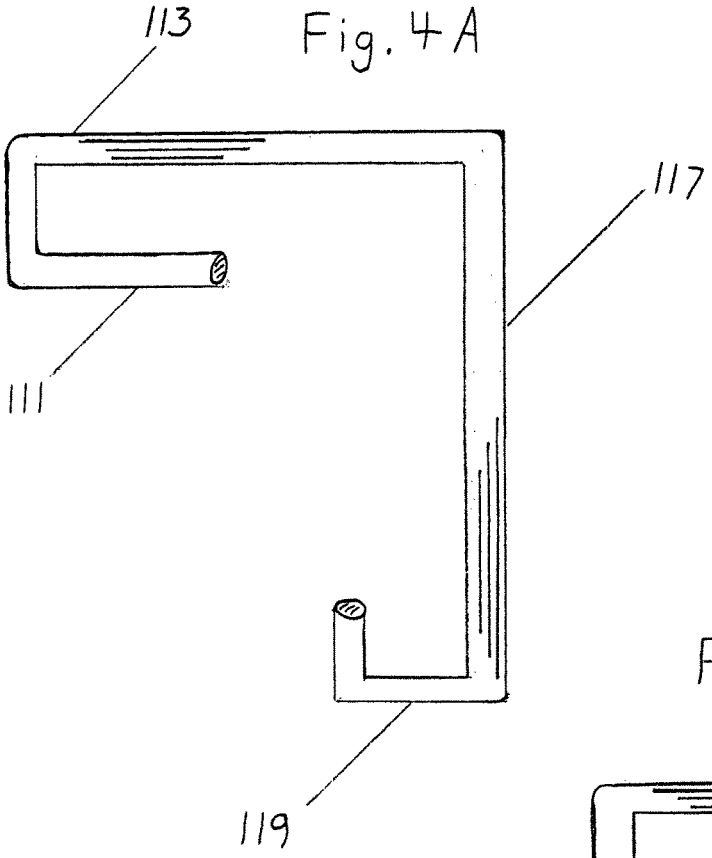
FIG. 4A is a design of an upper horizontal rectangular hook with a vertical design handle, and a rectangular lower vertical hook.
Figure 4B:
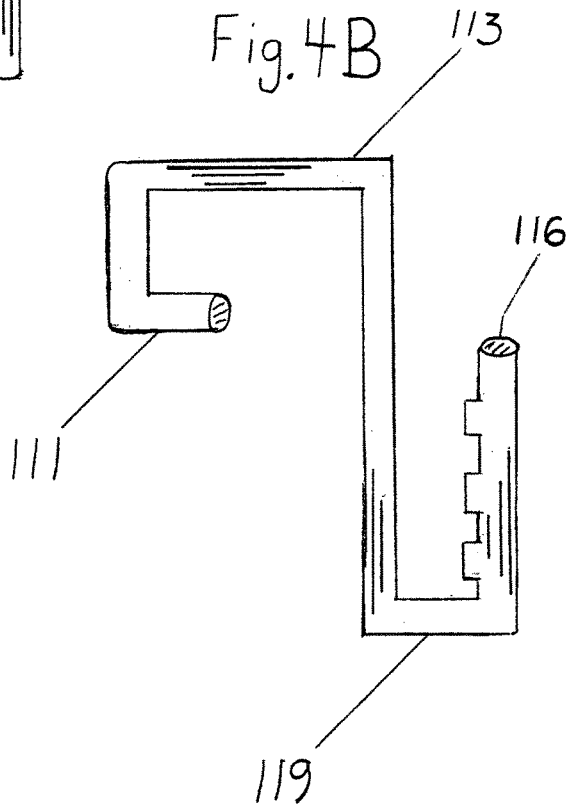
FIG. 4B shows a bottom mounted vertical design grip handle with a rectangular lower vertical hook, and an upper horizontal rectangular hook.
Figure 4C:
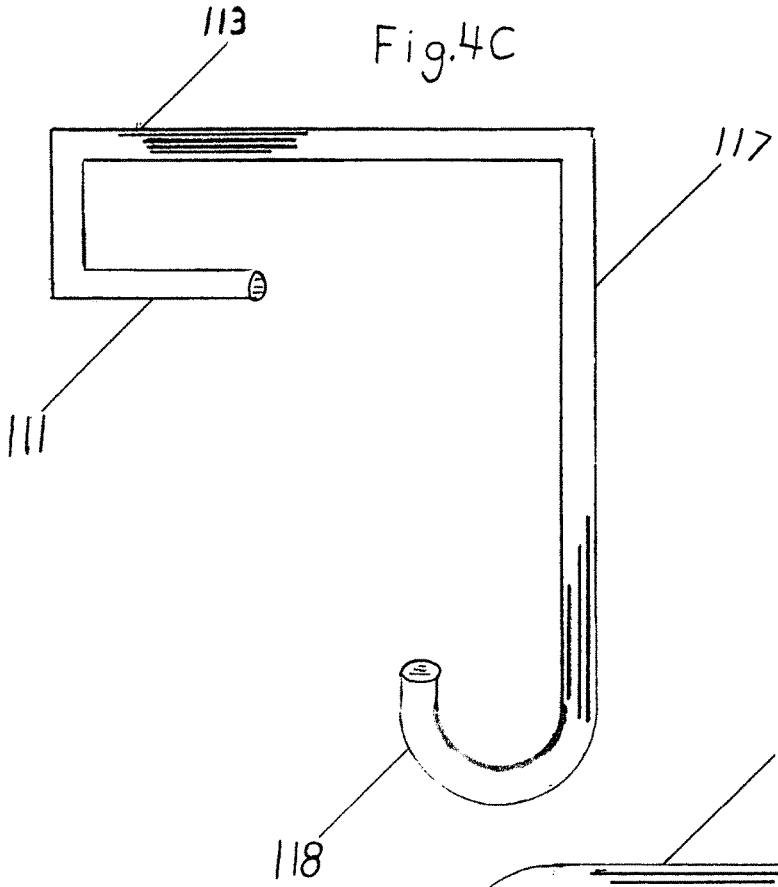
FIG. 4C illustrates an upper horizontal rectangular hook with a vertical design handle, and a lower vertical hook.
Figure 4D:
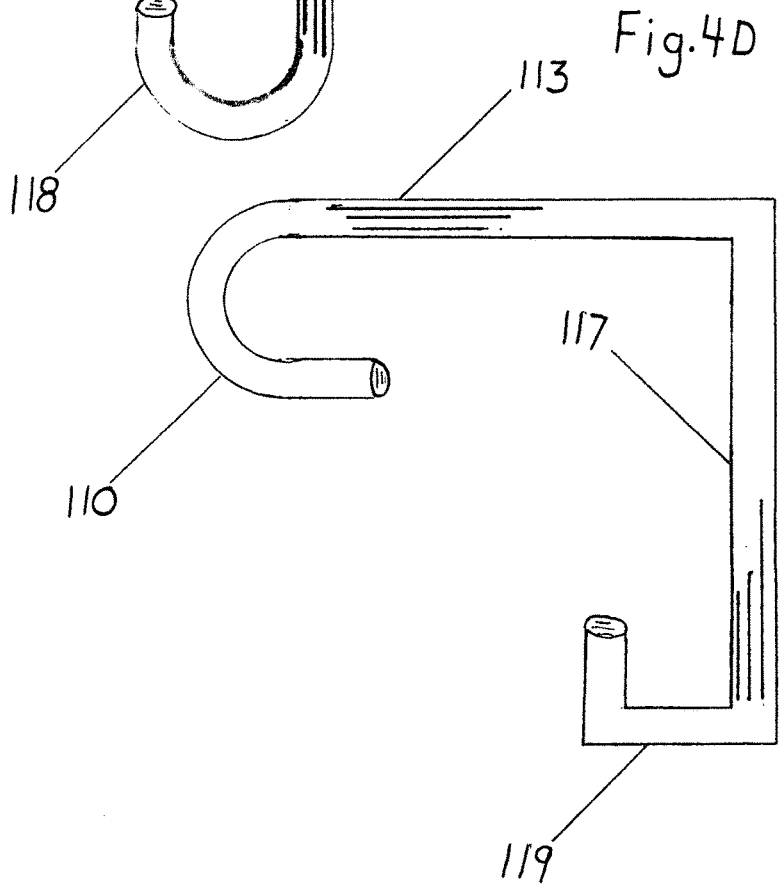
FIG. 4D shows an upper horizontal hook with a vertical design handle, and a lower rectangular vertical hook.
Figure 4E:
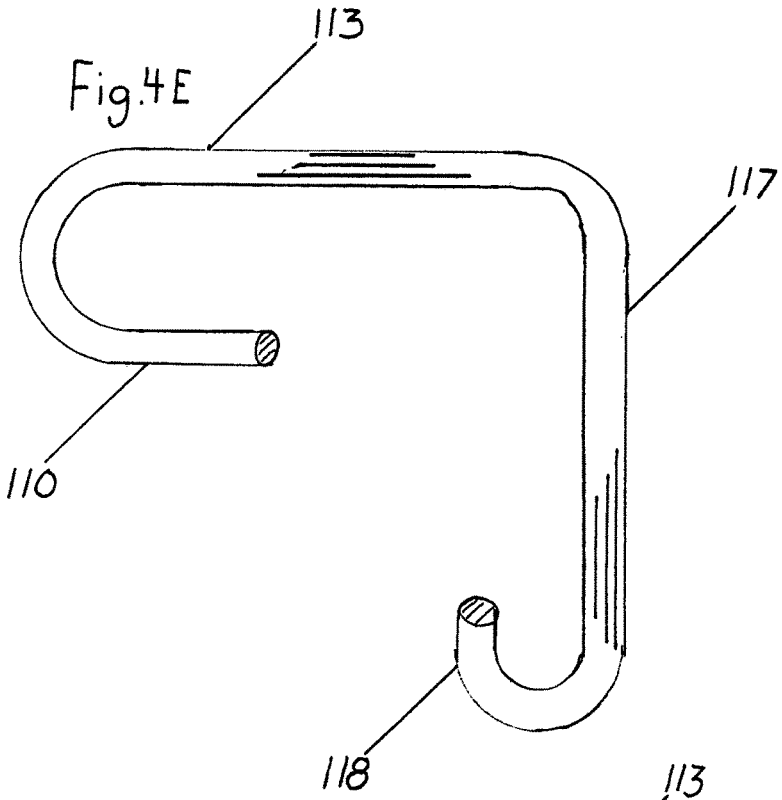
FIG. 4E is a design of an upper horizontal hook with a vertical design handle, and a lower vertical hook.
Figure 4F:
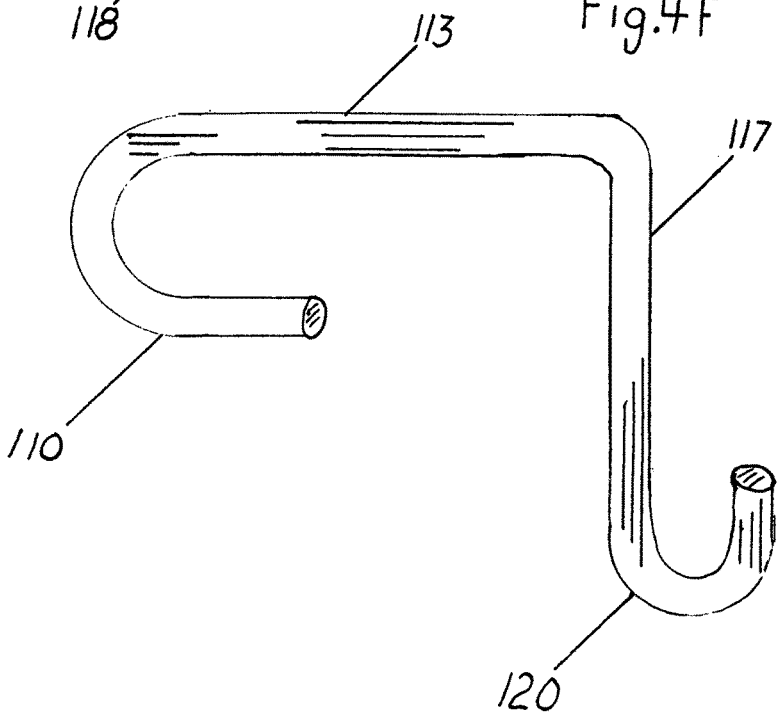
FIG. 4F illustrates an upper horizontal frame with a vertical design handle, and a lower reversed design vertical hook.
Figure 4I:
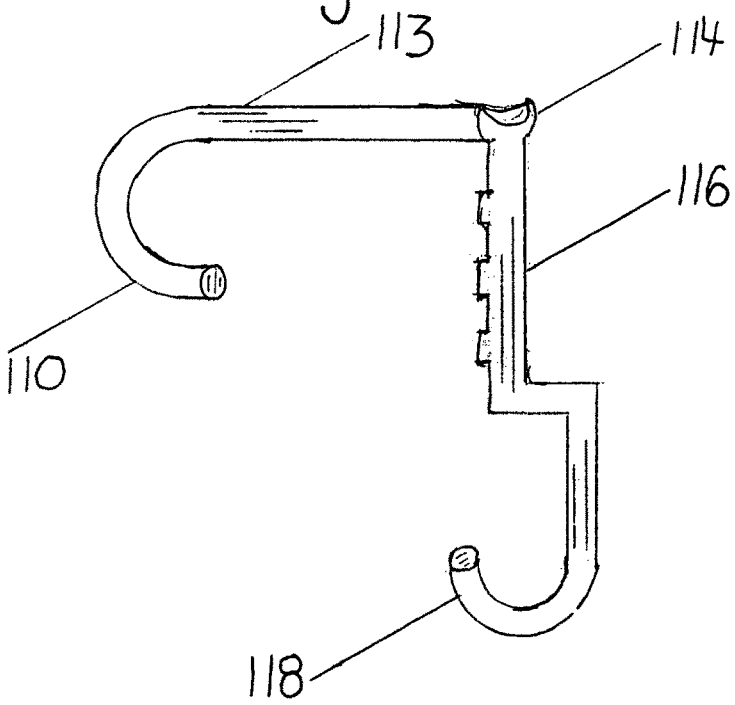
FIG. 4I illustrates an upper horizontal hook with a vertical design handle, and a lower vertical hook. This also displays a vertical thumb rest.
Figure 4J:
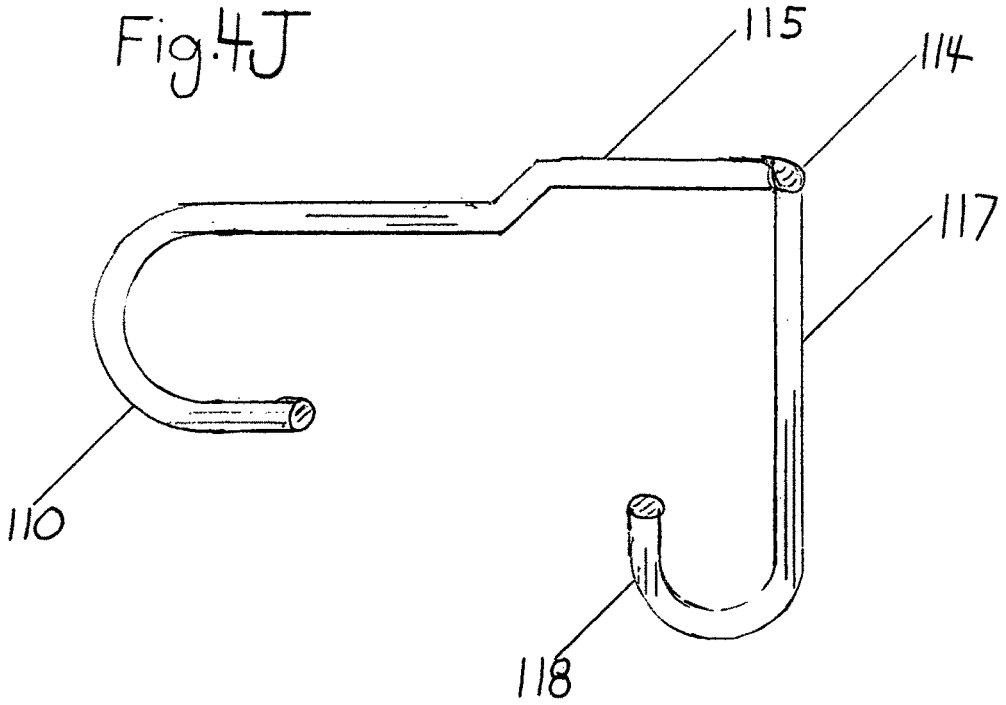
FIG. 4J displays an upper horizontal hook with a 45 degree offset horizontal frame, and a vertical design grip handle with lower vertical hook.
Figure 4Q:
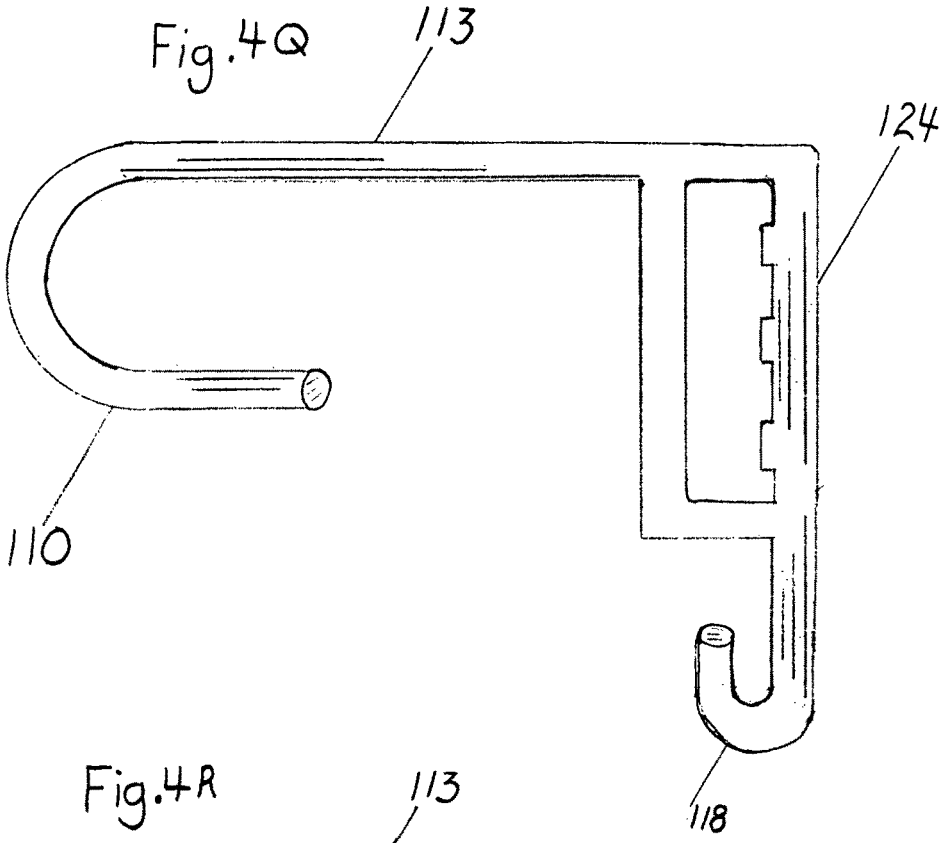
FIG. 4Q shows an upper horizontal hook, and a horizontal frame with vertical closed grip design handle, and a lower vertical hook.
Figure 4R:
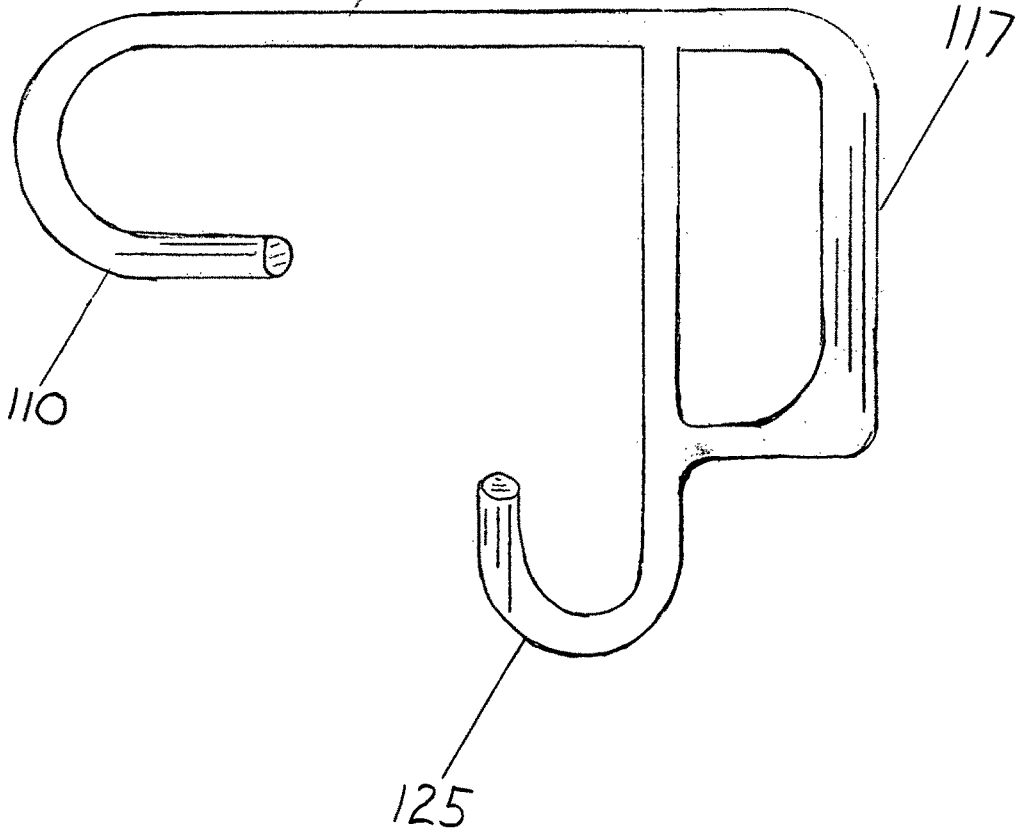
FIG. 4R displays an upper horizontal hook, and a horizontal frame with a vertical design handle, and a left side mount lower vertical hook.
Figure 4S:
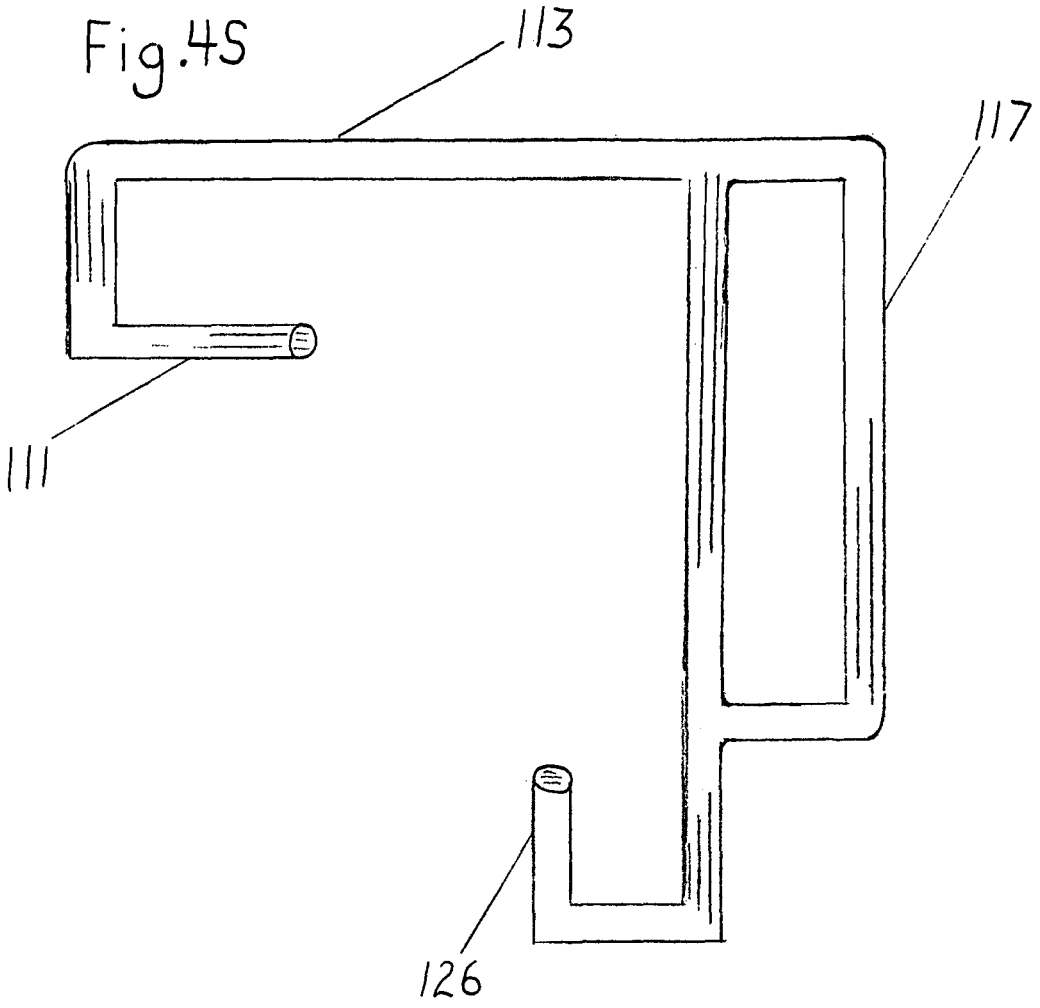
FIG. 4S illustrates an upper horizontal rectangular hook with a vertical design handle, and a left side mount lower rectangular vertical hook.
Figure 4T:
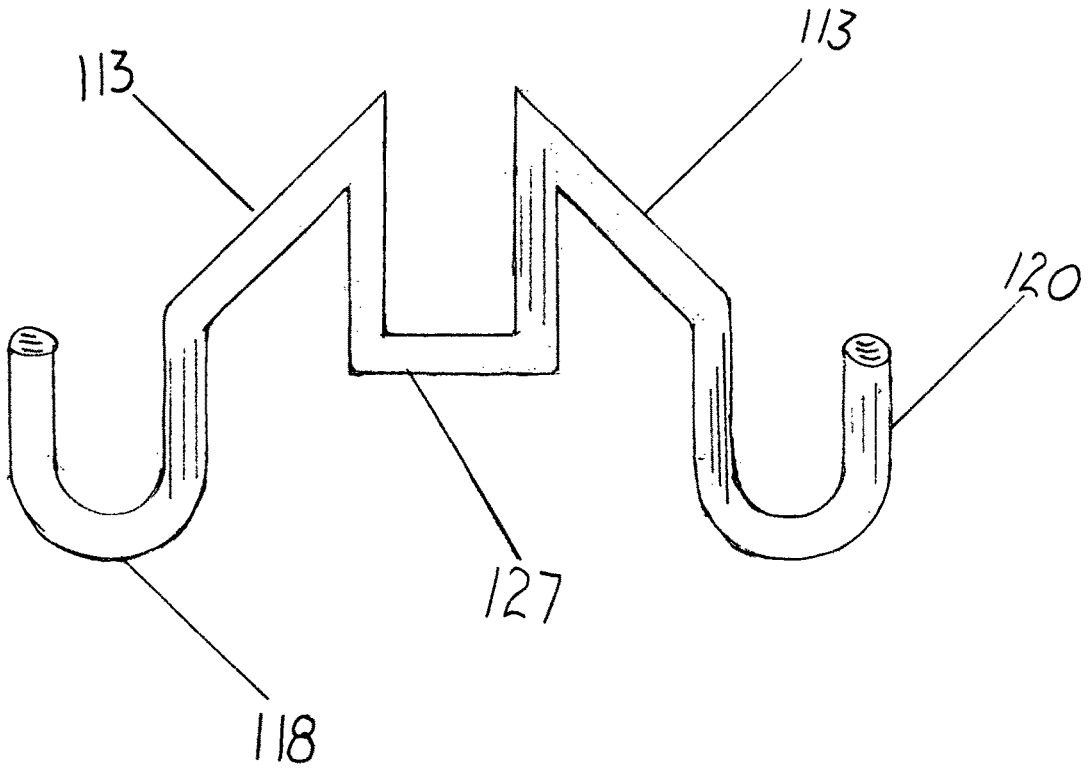
FIG. 4T shows an upper horizontal frame with a rectangular cradle, and a lower vertical hook, and a lower reversed vertical hook.
Figure 4U:
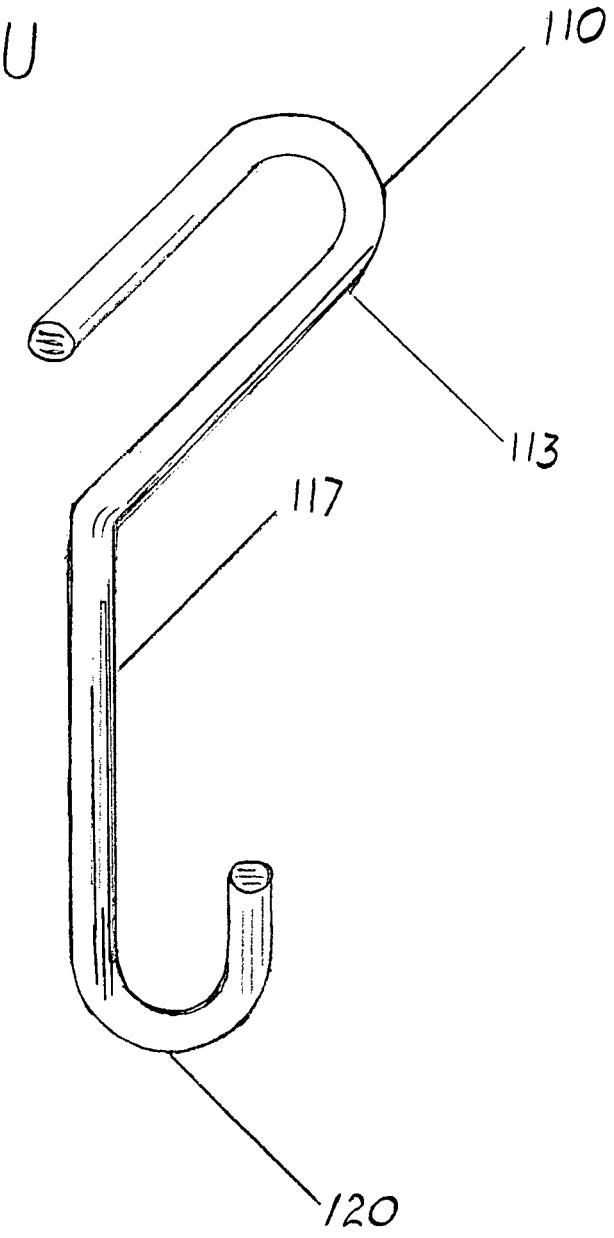
FIG. 4U displays an upper horizontal hook, and a lower reversed design vertical hook.

FIGS. 1, 2 and 3 will illustrate the intended use and operation of the step ladder bucket hook with vertical design grip handle. FIG. 1 illustrates the rounded step ladder step hook 110. This hook is designed to hang easily and securely to a step of a step ladder. 45 degree offset horizontal frame 112 and vertical design grip handle 116 are both connected to give the user an easy-to-grip fast-action handle for maneuvering the bucket from step ladder step to step on a step ladder. Lower vertical bucket hook 118 connects to vertical design grip handle 116 to complete the handle. The user can attach a can of paint, or utility bucket to the lower vertical hook 118. This will create a one-piece unit for the user. The user can now move the can of paint, or utility bucket fast and efficient from step ladder step to step on a step ladder in a safe and secure manner.

FIG. 2 illustrates a side view of the rounded step ladder step hook 110. Vertical design grip handle 116 connects to vertical thumb rest 114 and 45 degree offset horizontal frame 112 and also lower vertical hook 118. A full can of paint or utility bucket will be securely attached to lower vertical hook 118 through the can of paint or utility buckets wire handle.

FIG. 2 show broken lines replicating a step ladder, with the can of paint securely attached onto.

FIG. 2 also shows the can of paint securely attached to lower vertical hook 118. Therefore, giving the painter or homeowner; a single unit to move quickly and efficiently from step to step on a step ladder.

FIG. 2 also illustrates the vertical design grip handle for hand-held gripping, for left or right-handed painters enabling workers to move the can of paint, or utility bucket fast and efficiently from step to step on a step ladder.

FIG. 3 illustrates the front view.

Advantages

From the description above, a number of advantages of our present invention are evident:

(a) The painter can very quickly move the step ladder bucket hook with the can of paint or utility bucket attached to it as a single unit.
(b) The user can safely transport the step ladder bucket hook as a single unit to the desired position on a step ladder with one hand.
(c) As the work progresses, the user can very easily and quickly reposition the paint can or utility bucket on either side of a step ladder, left or right side of the step.
(d) As the painting progresses, the painter can move the paint can or utility bucket up or down the step of the step ladder in a fast and safe manner.
(e) The user can be a right- or left-handed person.
(f) The step ladder bucket hook is simple and lightweight for ease of use.
(g) The step ladder bucket hook can be economically manufactured in quantities.
(h) The step ladder bucket hook makes a worker's job faster, safer, easier and increases their paint production by saving time, through its quick grip handle.
(i) The user now has an easy way to attach a bucket to a step ladder.
(j) The user can attach a 5 gallon bucket to the step ladder bucket hook and paint with a paint roller.
(k) The user can also attach an empty 5 gallon bucket to the step ladder bucket hook for gutter cleaning, window washing, fruit picking and carrying tools.
(l) The homeowner can achieve better balance through means of the 45 degree offset vertical design handle.
(m) The user can grip the handle quicker through the 90 degree horizontal frame.
(n) The painter has a better center of gravity through the alternative 45 degree offset vertical handle. This will give the painter better control movement up or down the step ladder.
(o) The homeowner can move the can of paint or utility bucket easier from step to step on a step ladder.
(p) The tradesperson has better balance using a 5 gallon bucket on a step ladder.

(q) The user has better stability with a 5 gallon bucket through means of the closed grip design handle.

(r) The homeowner can increase productivity through means of the left side mount lower vertical hook.

(s) The painter can move different size gallon buckets through means of the left side mount lower rectangular vertical hook.

(t) The user can safely hang a bucket of tools, and a bucket of paint through means of the alternative left and right side vertical hooks.

(u) The homeowner has easy access to their bucket of tools through means of the side rail attachment.

CONCLUSION, RAMIFICATIONS, AND SCOPE

The present invention is an innovative simple design solution, for attaching a can of paint or utility bucket to a step ladder. The emphasis of the invention is primarily directed toward addressing the key issues of the painter's productivity, ease of use and safety while painting on a step ladder. The easy-to-grip handle on our step ladder bucket hook makes this hook simple and unique. Furthermore, the painter can hold onto the step ladder safely with one hand, and move the can of paint or utility bucket with the other hand in a quick and safe manner.

Although the description of the present invention contains specifics of the preferred embodiment, these should not be construed as limiting the scope of the invention. The embodiment described herein is subject to variation in structure, design, and manufacturing methodology. For example, practical variable alternatives are presented herein for a handle grip.

Accordingly, the scope of the invention should be determined by the appended claims and their legal equivalents, and not be limited to the details disclosed herein.

We claim:

1. A paint bucket step ladder hook assembly for suspending a paint bucket to a step ladder comprising: an upper horizontal hook and a lower vertical hook intersecting at an upper end of a shank of the lower vertical hook and a shank of the upper horizontal hook, the lower vertical hook having protuberances forming a vertical design hook grip handle integrated into the lower vertical hook; wherein the upper horizontal hook is configured for suspension from a step ladder step, and the lower vertical hook is configured for supporting a paint bucket; wherein the lower vertical hook and the upper horizontal hook are a one-piece design and connected to the vertical design hook grip handle, an upper end of the vertical design grip handle is integrally formed and connected to a lower end of a vertical thumb rest, the vertical thumb rest formed and connected to a 45 degree offset horizontal frame; wherein the 45 degree offset horizontal frame is integrally formed and connected to the upper horizontal hook.

* * * * *